US005917515A

United States Patent [19]

Nonoyama et al.

[11] Patent Number: 5,917,515

[45] Date of Patent: Jun. 29, 1999

[54] INK JET PRINTER HAVING BACKUP UNIT WITH ANY ONE OR BOTH OF A PUMP MECHANISM AND A NOZZLE CAP MECHANISM

[75] Inventors: Shigeo Nonoyama; Yoshiki Nagasaki, both of Kawasaki; Takumi Kawamura, Inagi; Shigeru Akema, Kawasaki, all of Japan

[73] Assignee: Fujitsu Limited, Kanagawa, Japan

[21] Appl. No.: 08/512,640

[22] Filed: Aug. 8, 1995

[30] Foreign Application Priority Data

Dec. 19, 1994 [JP] Japan ..... 6-315310

[51] Int. Cl.[6] ..... B41J 2/165; F04B 43/00

[52] U.S. Cl. ..... 347/30; 417/412; 417/472

[58] Field of Search ..... 347/30, 29; 417/472–490, 417/547, 413.1, 412; 251/333

[56] References Cited

U.S. PATENT DOCUMENTS

| | | | |
|---|---|---|---|
| 9,853 | 6/1853 | Stange | 251/333 |
| 862,867 | 8/1907 | Eggleston | 417/490 |
| 4,577,203 | 3/1986 | Kawamura | 347/30 |
| 5,260,724 | 11/1993 | Tomii et al. | 347/30 |
| 5,565,899 | 10/1996 | Sugimoto et al. | 347/30 |

*Primary Examiner*—N. Le
*Assistant Examiner*—Thien Tran
*Attorney, Agent, or Firm*—Armstrong, Westerman, Hattori, McLeland & Naughton

[57] ABSTRACT

A backup unit is provided with respect to a nozzle of a print head for printing by injecting ink, and sucks the ink from the nozzle, the backup unit including: a nozzle cap sealing the nozzle by making contiguous contact with the print head; a pump; and an ink path communicating the nozzle cap and the pump; wherein the pump includes: a bellows part having an internal space formed therein; a movable rod fixed to the bellows part and having an ink passage therein; a slide valve provided in the bellows part and slidable with respect to the rod, the slide valve closing and opening a hole provided at one end of the ink passage with respect to the internal space, depending on a position of the movable rod; an ink inlet provided at the other end of the ink passage and communicating with the ink path; and an ink outlet communicating with the internal space depending on a position of the slide valve, the slide valve having a stroke shorter than a stroke of the rod, a volume of the internal space within the bellows part increasing and decreasing as the slide valve makes a reciprocating motion in a direction parallel to a center axis of the rod, the slide valve sucking the ink from the nozzle via the ink inlet by opening the hole of the ink passage to the internal space when the rod is at a position where the volume of the internal space is a maximum, and discharging the ink in the internal space via the ink outlet as the volume of the internal space decreases.

6 Claims, 14 Drawing Sheets

INK JET PRINTER HAVING BACKUP UNIT WITH ANY ONE OR BOTH OF A PUMP MECHANISM AND A NOZZLE CAP MECHANISM

BACKGROUND OF THE INVENTION

1. Field of the Invention

The present invention relates to backup units and ink-jet printers, and more particularly to a backup unit equipped with a pump mechanism and/or a nozzle cap mechanism and to an ink-jet printer having a such a backup unit.

2. Description of the Prior Art

An ink-jet printer is constructed such that characters or the like are printed on recording medium such as paper by injecting an ink from a thin nozzle of a print head. There are several kinds of inconveniences that could occur in the ink-jet printer. For example, the ink becomes dried and thickened in the nozzle. Or paper powder may be attached to the nozzle that is wet from the ink, resulting in the nozzle being covered by the powder. Or air bubbles may enter the print head through the nozzle as a result of disturbance like an oscillation. If nothing is done to overcome these inconveniences, the nozzle may be wholly or partly clogged, causing the ink to be injected improperly. Or the pressure for injecting the ink may be canceled by the air bubbles, causing the ink to be injected imperfectly. Either way, the printing quality is degraded significantly. Accordingly, a backup unit is required to inject the ink powder from the nozzle in a stable manner.

A backup unit removes the thickened ink, the air bubbles, the paper powder or the like from the print head, by forcefully sucking the ink from the nozzle. The backup unit is a kind of print head protection mechanism for performing a restoring action in which a normal condition of the nozzle is restored by removing the clogging of the nozzle. This restoring action will be referred to as a purging action. The purging action is performed during an initialization immediately after the turning ON of the ink-jet printer or performed at a timing specified by a user.

A conventional backup unit comprises a pump for the purging action and valves provided at an inlet and an outlet of the pump. There is a problem in that, because of the valves provided, the backup unit becomes relatively large, requiring a relatively large space inside the ink-jet printer. Another problem is that, since these valves are constructed to open and close in response to the pressure produced in the pump, the response thereof is poor. Therefore, it takes a relatively long time for the valves to be activated. Further, it is to be noted that the higher the speed of the flow of the ink during the purging action, the higher the effect of storing the nozzle to normal. A problem is that, if the conventional pump structure is employed to realize a high flow speed, the size of the pump itself becomes large because the pump has to produce a large negative pressure. If the pump is large, it is required that the power for driving the pump be large.

The backup unit includes a nozzle cap for sealing the nozzle in order to prevent the ink from being dried or thickened in the nozzle when the print head is not in use; for example, when the ink-jet printer is turned OFF. The nozzle cap is connected to a pump for carrying out the purging action in a tube. A failure for the nozzle cap to seal the nozzle properly by being attached thereto in a most suitable position may occur due to errors in mounting a movable carriage to which the print head is fitted, the print head or the nozzle cap itself. The failure may also occur due to a bending force of the tube connected to the nozzle cap. In other words, there is a problem in that the sealing of the nozzle by the nozzle cap may be imperfect due to the mounting errors or the like. If the sealing of the nozzle is imperfect, the ink may be dried or thickened in the nozzle, or the negative pressure required for the purging action by the pump is insufficient. Thus, the backup unit may not be operated properly.

SUMMARY OF THE INVENTION

Accordingly, an object of the present invention is to provide novel and useful backup units and ink-jet printers in which the aforementioned problems are eliminated.

Another and more specific object of the present invention is to provide a backup unit comprising a pump mechanism having a simple, compact construction, a good response and a capability of producing a large negative pressure using a relatively small driving power; and/or a nozzle cap mechanism capable of sealing the nozzle of the print head perfectly using a relatively simple construction. A related object of the present invention is to provide an ink-jet printer having such an improved backup unit.

The aforementioned objects can be achieved by a backup unit which is provided with respect to a nozzle of a print head for printing by injecting ink, and which sucks the ink from the nozzle, the backup unit comprising: a nozzle cap sealing the nozzle by making contiguous contact with the print head; a pump; and an ink path communicating the nozzle cap and the pump; wherein the pump comprises: a bellows part having an internal space formed therein; a movable rod fixed to the bellows part and having an ink passage therein; a slide valve provided in the bellows part and slidable with respect to the rod, the slide valve closing and opening a hole provided at one end of the ink passage with respect to the internal space, depending on a position of the movable rod; an ink inlet provided at the other end of the ink passage and communicating with the ink path; and an ink outlet communicating with the internal space depending on a position of the slide valve, the slide valve having a stroke shorter than a stroke of the rod, a volume of the internal space within the bellows part increasing and decreasing as the slide valve makes a reciprocating motion in a direction parallel to a center axis of the rod, the slide valve sucking the ink from the nozzle via the ink inlet by opening the hole of the ink passage to the internal space when the rod is at a position where the volume of the internal space is a maximum, and discharging the ink in the internal space via the ink outlet as the volume of the internal space decreases. According to the present invention, the construction of the backup unit is simple and does not require a large mounting space inside the ink-jet printer. Further, since the slide valve of the pump is not constructed to open or close in response to the pressure in the pump, the response thereof is good. Therefore, it takes little time for the valve to be activated. While the pump of the present invention is relatively compact, its effect in restoring the nozzle to its normal condition is great because the initial speed of the ink in a purging action is high. Despite the large negative pressure produced by the pump of the present invention, the power required to drive the pump may be relatively small.

In a preferred embodiment, the slide valve opens the hole of the ink passage to the atmosphere when the rod is at a position where the volume of the internal space is approximately a minimum. According to this aspect of the present invention, the likelihood of the positive pressure being produced in the pump for a moment and forcing an air into the nozzle is eliminated.

In another preferred embodiment, the slide valve makes the internal space a closed space by closing the hole of the ink passage with respect to the internal space when the rod is at the position where the volume of the internal space is approximately a minimum. According to this aspect of the present invention, it is possible to open or close the slide valve using a short stroke.

In another preferred embodiment, the backup unit further comprises driving means for driving the rod to make at least one reciprocating motion in a state where the nozzle cap is in contiguous contact with the print head and to make at least one reciprocating motion in a state where the nozzle cap is separated from the print head. According to this aspect of the present invention, a first part of the purging action eliminates air bubbles or the like in the nozzle, and a second part of the purging action ensures that the residual ink in the ink passage or the like are properly removed.

In another preferred embodiment, the slide valve comprises a valve body having a generally cone shape with an apex angle in a range of 90° to 180°, and a plurality of concentric projections provided on the valve body, the contiguous projections maintaining airtightness within the pump. According to this aspect of the present invention, it is possible to maintain a satisfactory airtightness between the slide valve and the corresponding valve seat. Even if paper powder or the hardened ink enters a space between the slide valve and the valve seat it is highly likely that a satisfactory air tightness is maintained.

In another preferred embodiment, the backup unit further comprises a mechanism for resiliently supporting the nozzle cap. According to this aspect of the present invention, the nozzle cap can be attached to the print head without fail. Therefore, there will be no leakage that decreases the negative pressure. Thus, the purging action can be performed without fail.

In another preferred embodiment, the backup unit further comprises a mechanism moving the nozzle cap substantially parallel to the print head so that the nozzle cap makes contiguous contact with the print head in response to a movement of the print head to a stand-by position. According to this aspect of the present invention, the nozzle cap can be attached to the print head in a very favorable condition even if there are mounting errors or the like of the print head etc. Therefore, there will be no leakage that decreases the negative pressure. Thus, the purging action can be performed without fail.

The aforementioned objects can also be achieved by a backup unit which is provided with respect to a nozzle of a print head for printing by injecting ink, and which sucks the ink from the nozzle, the backup unit comprising: a nozzle cap sealing the nozzle by making contiguous contact with the print head; a pump; an ink path communicating the nozzle cap and the pump; and a mechanism resiliently supporting the nozzle cap. According to the backup unit of the present invention, it is possible to attach the nozzle cap to the print head properly. Hence, it is possible to prevent the ink in the print head from being evaporated. Further, there will be no leakage that decreases the negative pressure.

In a preferred embodiment, the backup unit described above further comprises a mechanism moving the nozzle cap substantially parallel to the print head so that the nozzle cap makes contiguous contact with the print head in response to a movement of the print head to a stand-by position. According to this aspect of the present invention, the nozzle cap can be attached to the print head in a very favorable condition even if there are mounting errors or the like of the print head etc. Therefore, it is possible to prevent the ink in the print head from being evaporated. Further, there will be no leakage that decreases the negative pressure.

The aforementioned objects can also be achieved by an ink-jet printer comprising: a print head having a nozzle injecting ink; and a backup unit which is provided with respect to the nozzle of the print head, and which sucks the ink from the nozzle, the backup unit comprising: a nozzle cap sealing the nozzle by making contiguous contact with the print head; a pump; and an ink path communicating the nozzle cap and the pump; wherein the pump comprises: a bellows part having an internal space formed therein; a movable rod fixed to the bellows part and having an ink passage therein; a slide valve provided in the bellows part and slidable with respect to the rod, the slide valve closing and opening a hole provided at one end of the ink passage with respect to the internal space, depending on a position of the movable rod; an ink inlet provided at the other end of the ink passage and communicating with the ink path; and an ink outlet communicating with the internal space depending on a position of the slide valve, the slide valve having a stroke shorter than a stroke of the rod, a volume of the internal space within the bellows part increasing and decreasing as the slide valve makes a reciprocating motion in a direction parallel to a center axis of the rod, the slide valve sucking the ink from the nozzle via the ink inlet by opening the hole of the ink passage to the internal space when the rod is at a position where the volume of the internal space is a maximum, and discharging the ink in the internal space via the ink outlet as the volume of the internal space decreases. According to the ink-jet printer of the present invention, the construction of the backup unit is simple and does not require a large mounting space inside the ink-jet printer. Further, since the slide valve of the pump is not constructed to open or close in response to the pressure produced in the pump, the response thereof is good. Therefore, it takes little time for the valve to be activated. While the pump of the present invention is relatively compact, its effect in restoring the nozzle to its normal condition is great because the initial speed of the ink in a purging action is high. Despite the large negative pressure produced by the pump of the present invention, the power required to drive the pump may be relatively small. A reliable and improved purging action can be performed with a relatively small power consumption. Also, air bubbles or the like inside the nozzle of the print head can be removed in a reliable manner. Therefore, the printing quality is improved.

In a preferred embodiment, the slide valve opens the hole of the ink passage to the atmosphere when the rod is at a position where the volume of the internal space is approximately a minimum. According to this aspect of the present invention, the likelihood of the positive pressure being produced in the pump for a moment and forcing an air into the nozzle is eliminated. Thus, the printing quality is further improved.

In another preferred embodiment, the slide valve makes the internal space a closed space by closing the hole of the ink passage with respect to the internal space when the rod is at the position where the volume of the internal space is approximately a minimum. According to this aspect of the present invention, it is possible to open or close the slide valve using a short stroke.

In still another preferred embodiment, the ink-jet printer further comprises driving means for driving the rod to make at least one reciprocating motion in a state where the nozzle cap is in contiguous contact with the print head and to make at least one reciprocating motion in a state where the nozzle cap is separated from the print head. According to this aspect of the present invention, a first part of the purging action eliminates air bubbles or the like in the nozzle, and a second part of the purging action ensures that the residual ink in the ink passage or the like are properly removed. Thus, the reliability of the ink-jet printer is improved.

In another preferred embodiment, the slide valve comprises a valve body having a generally cone shape with an apex angle in a range of 90° to 180°, and a plurality of concentric projections provided on the valve body, the contiguous projections maintaining airtightness within the pump. According to this aspect of the present invention, it is possible to maintain a satisfactory airtightness between the slide valve and the corresponding valve seat. Even if paper powder or the hardened ink enters a space between the slide valve and the valve seat it is highly likely that a satisfactory air tightness is maintained.

In another preferred embodiment, the ink-jet printer further comprises: a mechanism resiliently supporting the nozzle cap; and a mechanism moving the nozzle cap substantially parallel to the print head so that the nozzle cap makes contiguous contact with the print head in response to a movement of the print head to a stand-by position. According to this aspect of the present invention, the nozzle cap can be attached to the print head in a reliable manner even if there are mounting errors or the like of the print head etc. Therefore, there will be no leakage that decreases the negative pressure. Thus, the purging action can be performed without fail.

The aforementioned objects can also be achieved by an ink-jet printer comprising: a print head for printing by injecting ink; and a backup unit which is provided with respect to a nozzle of the print head, and which sucks the ink from the nozzle, the backup unit comprising: a nozzle cap sealing the nozzle by making contiguous contact with the print head; a pump; an ink path communicating the nozzle cap and the pump; and a mechanism resiliently supporting the nozzle cap. According to this aspect of the present invention, it is possible to attach the nozzle cap to the print head properly. Hence, it is possible to prevent the ink in the print head from being evaporated. Further, there will be no leakage that decreases the negative pressure.

In yet another preferred embodiment, the ink-jet printer further comprises a mechanism moving the nozzle cap substantially parallel to the print head so that the nozzle cap makes contiguous contact with the print head in response to a movement of the print head to a stand-by position. According to this aspect of the present invention, the nozzle cap can be attached to the print head in a very favorable condition even if there are mounting errors or the like of the print head etc. Therefore, it is possible to prevent the ink in the print head from being evaporated. Further, there will be no leakage that decreases the negative pressure.

As has been described, according to the present invention, it is possible to realize a backup unit comprising: a pump mechanism having a simple, compact construction, a good response and a capability of producing a large negative pressure using a relatively small driving power; and/or a nozzle cap mechanism capable of sealing the nozzle of the print head perfectly using a relatively simple construction. Further, it is possible to realize an ink-jet printer having such an improved backup unit.

BRIEF DESCRIPTION OF THE DRAWINGS

Other objects and further features of the present invention will be apparent from the following detailed description when read in conjunction with the accompanying drawings, in which.

DESCRIPTION OF THE PREFERRED EMBODIMENTS

A description will be given, with reference to FIG. 1, of a first embodiment of the ink-jet printer according to the present invention.

Figure 1:
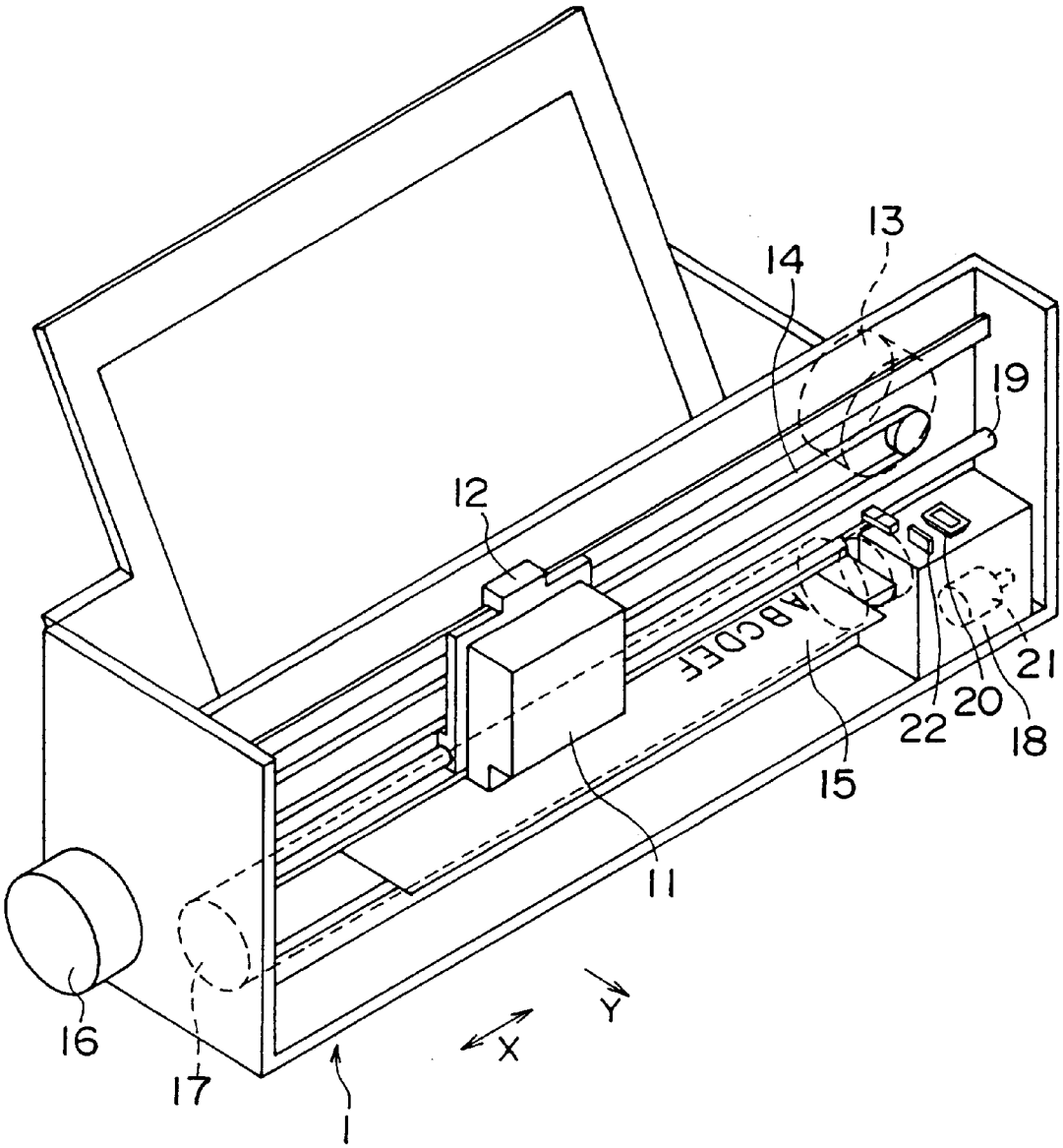
FIG. 1 is a perspective view of a first embodiment of an ink-jet printer.

FIG. 1 is a perspective view of the first embodiment of the ink-jet printer. The ink-jet printer generally comprises a frame 1, a print head 11, a carriage 12, a space motor 13, a timing belt 14, a line feed motor 16, a paper feed roller 17, a backup unit 18 and a guide stay 19.

In the first embodiment, the print head 11 is removably provided in the carriage 12. The ink is injected from a nozzle (not shown) of the print head 11 toward recording medium 15 such as paper, the injecting being done in a downward direction in FIG. 1. The carriage 12 is driven by the space motor 13 via the timing belt 14 and is translated in the X direction along the guide stay 19. Thus, the printing on the recording medium 15 is effected when the print head 11 is translated in the X direction. The recording medium 15 is fed by the line feed motor 16 in the Y direction indicated in FIG. 1 using a known paper feed mechanism (not shown) including the paper feed roller 17.

Figure 2:
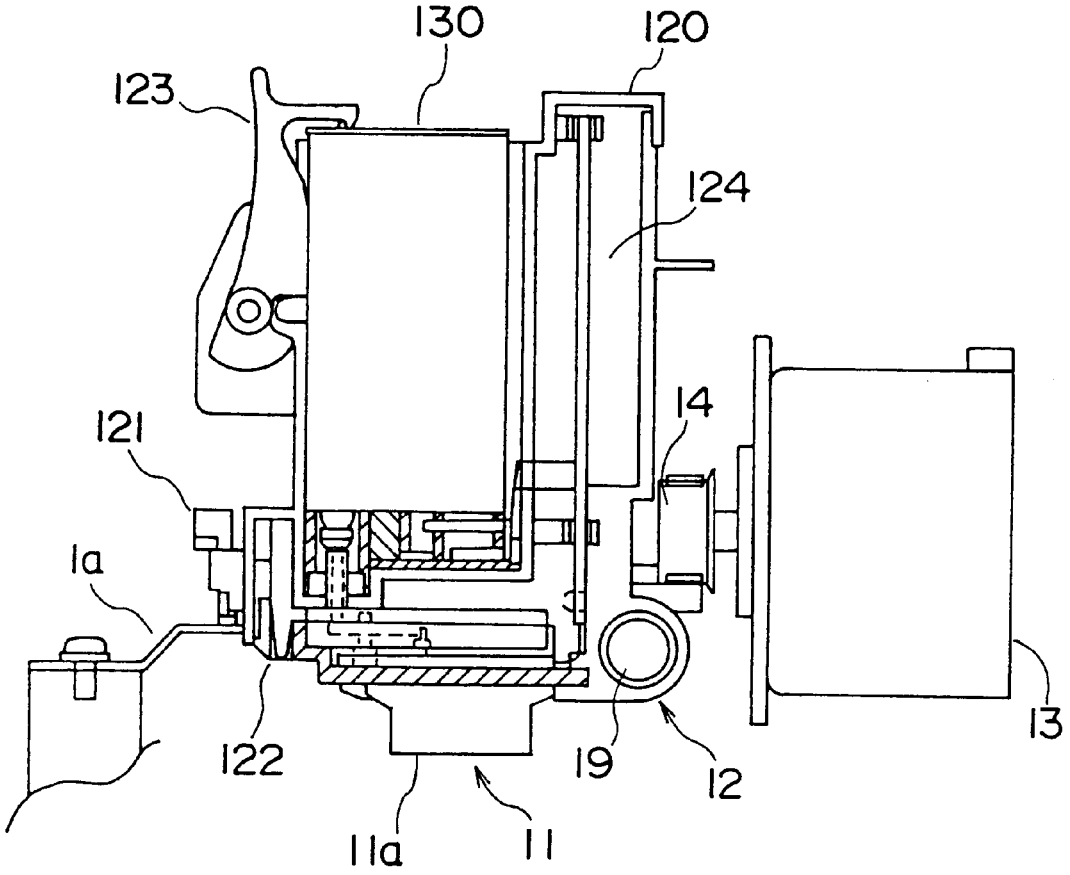
FIG. 2 is a lateral sectional view of a print head and a carriage.
Figure 12:
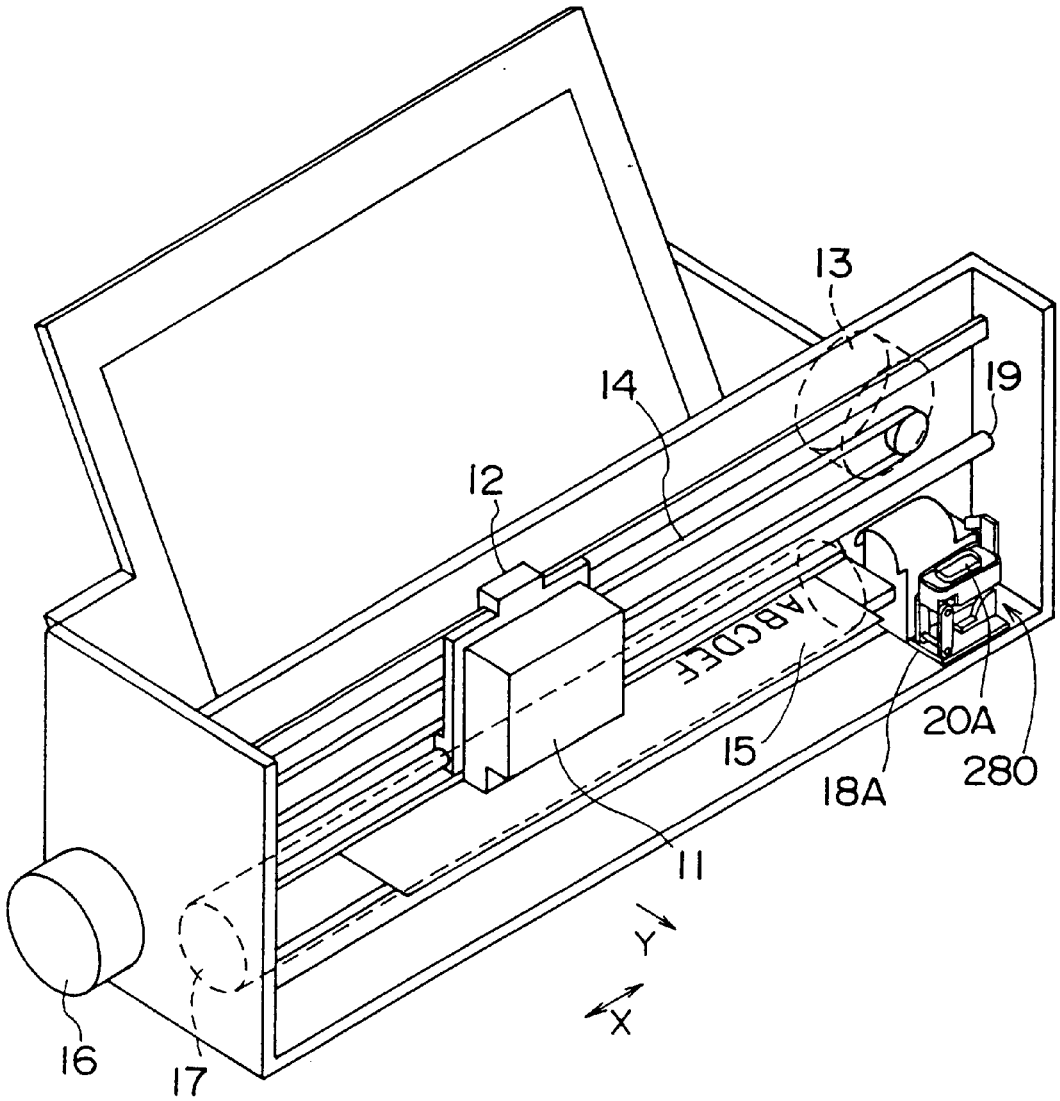
FIG. 12 is a perspective view showing a second embodiment the ink-jet printer.

FIG. 2 is a lateral sectional view of the print head 11 and the carriage 12. Referring to FIG. 12, a slider 121, a fixing spring 122, a lever 123 and a printed circuit board 124 are provided in a housing 120 constituting the carriage 12. The slider 121 is guided by a guide 1*a* provided in the frame 1 of the ink-jet printer. The fixing spring 122 is provided so as to eliminate looseness between the carriage 12 and the print head 11. The lever 123 is operated when the ink cartridge 130 is mounted to or removed from the print head 11. When the ink cartridge 130 is mounted to the print head 11, the lever 122 ensures that the ink cartridge 130 is locked in its predetermined position in the carriage 12. The printed circuit board 124 has a circuit etc. related to a predetermined operation of the ink-jet printer. 11*a* indicates a nozzle of the print head 11.

The backup unit 18 constitutes a feature of the present invention. In this embodiment, a first embodiment of the backup unit according to the present invention is used as the backup unit 18.

Figure 3:
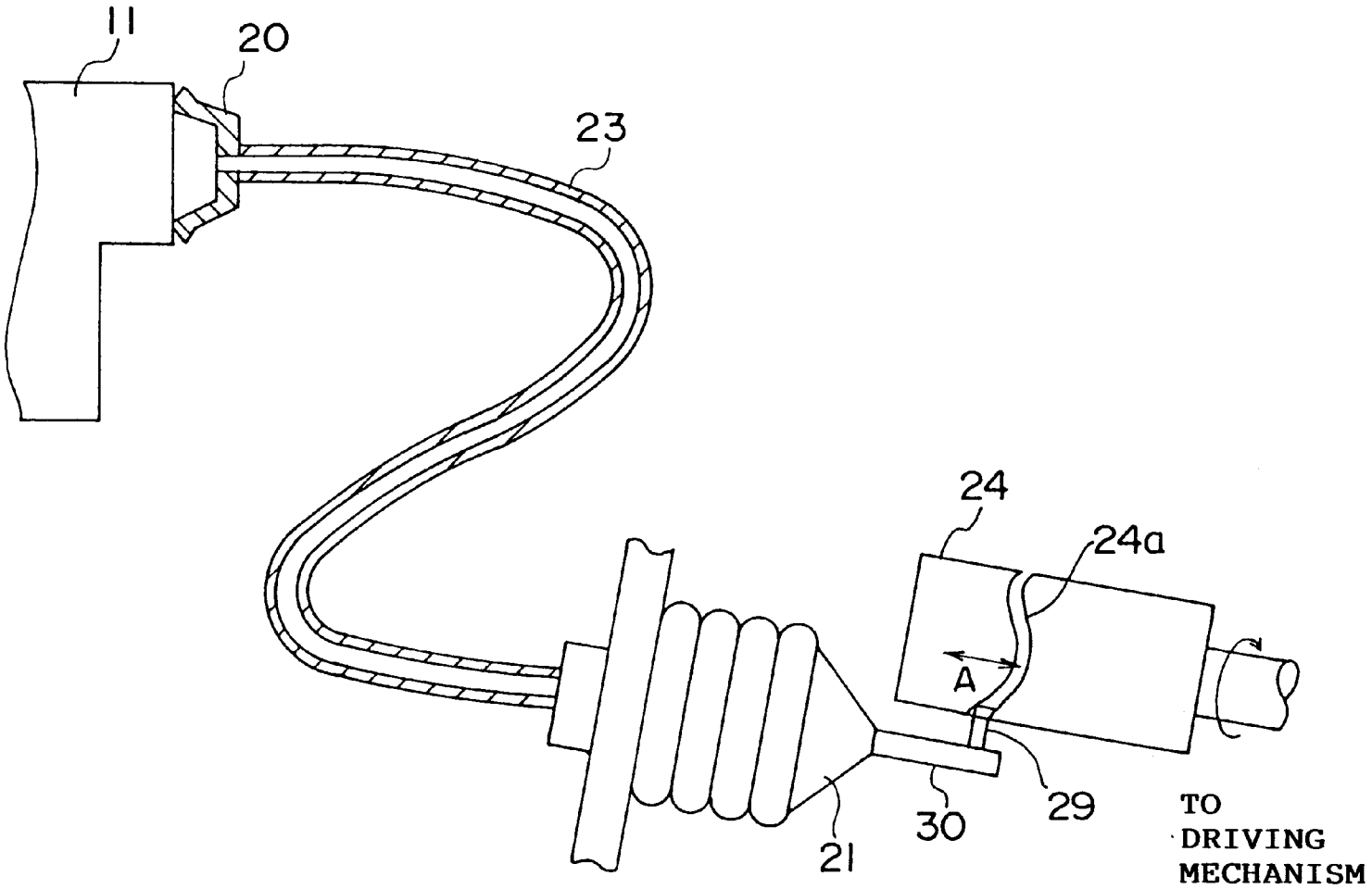
FIG. 3 is a diagram showing the basic construction of a first embodiment of a backup unit.

FIG. 3 is a diagram showing the basic construction of the first embodiment of the backup unit. In FIG. 3, a nozzle cap 20 and a tube 23 are shown in sectional views. As shown in FIG. 3, the backup unit 18 generally comprises: the nozzle cap 20, a pump 21, a wiper 22, the tube 23 and a drive shaft 24. When the carriage 12, in other words, the print head 11, is moved to a stand-by position at the right end of its translation (see FIG. 1), the nozzle of the print head 11 is cleaned by a wiper 22 so that the ink attached to the nozzle is removed. When the print head 11 arrives at the stand-by position, the nozzle cap 20 seals the nozzle. By driving the drive shaft 24 by a known driving mechanism (not shown) such as a motor, a projection 29 provided in a rod 30 of the pump 21 is guided by a cam 24*a* provided in the drive shaft 24 so that the rod 30 makes a reciprocating motion in a direction indicated by the arrow A in FIG. 3. As a result of this, the pump 21 effects suction via the tube 23, causing a space between the nozzle cap 20 and the nozzle to have a negative pressure. The purging action is carried out such that the thickened ink or the air bubbles in the nozzle is removed by suction.

The driving mechanism for driving the drive shaft 24 may be a motor for directly driving the drive shaft 24 or a motor for driving the drive shaft 24 via a belt or a gear. Alternative methods for driving the pump 21 other than the driving mechanism described above may be employed. For example, a construction whereby the rod 30 of the pump 21 is directly driven in the A direction using a plunger or the like may be employed.

Figure 4A:
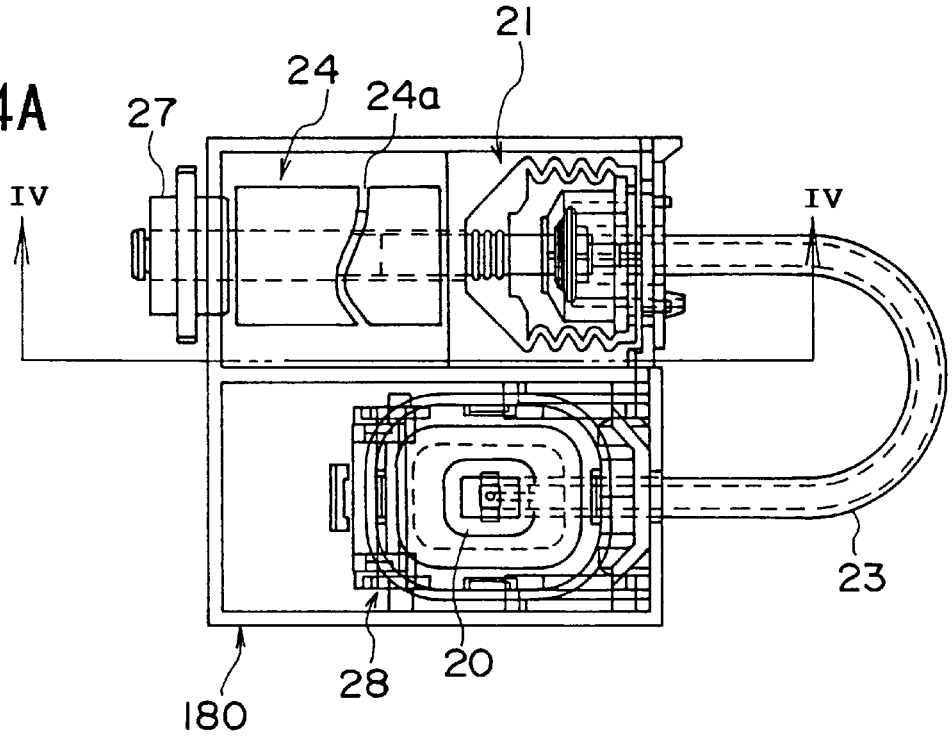
FIGS. 4A and 4B are diagrams showing an embodiment of arrangement of components in the backup unit.
Figure 4B:
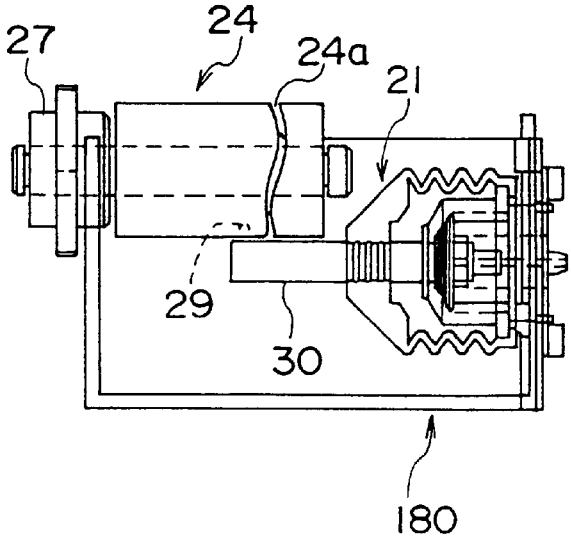

FIGS. 4A and 4B are diagrams showing an embodiment of arrangement of components in the backup unit 18. FIG. 4A is a top sectional view taken from above the ink-jet printer, and FIG. 4B is a lateral sectional view taken along the line IV—IV of FIG. 4A. In FIGS. 4A and 4B, those components that are the same as the components shown in FIG. 3 are designated by the same reference numerals, and the description thereof is omitted.

Referring to FIGS. 4A and 4B, the backup unit 18 includes a housing 180. The pump 21, the drive shaft 24 and a support mechanism 28 for supporting the nozzle cap 20 are provided in the housing 180. The nozzle cap 20 and the support mechanism 28 constitute a nozzle cap mechanism. While a major portion of the tube 23 is provided outside the housing 180 in this embodiment, it is of course possible to provide the entirety of the tube 23 inside the housing 180. The drive shaft 24 is driven by a motor 27 attached to the housing 180. While the motor 27 is fitted outside of the housing 180 in this embodiment, the motor 27 may be fitted inside the housing 180.

While a subunit constituted of the pump 21 and the drive shaft 24 and a subunit constituted of the nozzle cap 20 and the support mechanism 28 are arranged substantially side by side in this embodiment so as to restrict the height of the backup unit 18, the arrangement of the subunits is not limited to the one described.

A description will now be given, with reference to FIGS. 5A 5B and 5C, of the operation of the first embodiment of the pump 21. FIG. 5A is a lateral sectional view showing the pump 21 compressed FIG. 5B is a lateral sectional view showing the pump 21 in an interim state, and FIG. 5C is a lateral sectional view showing the pump 21 expanded.

Figure 5C:
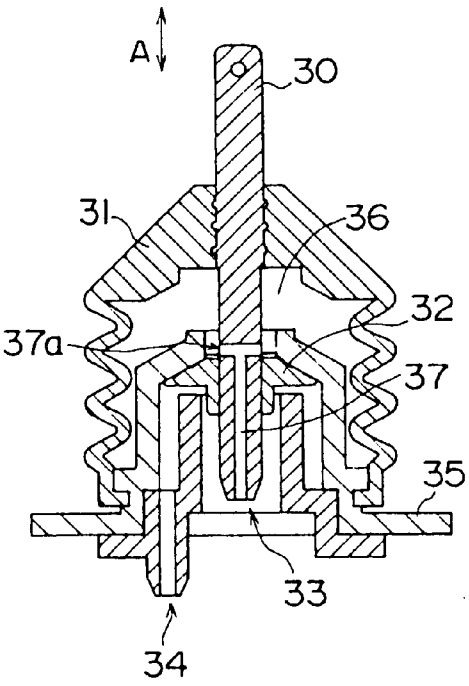
FIGS. 5A, 5B and 5C are sectional views which explain the operation of a first embodiment of a pump.
Figure 5B:
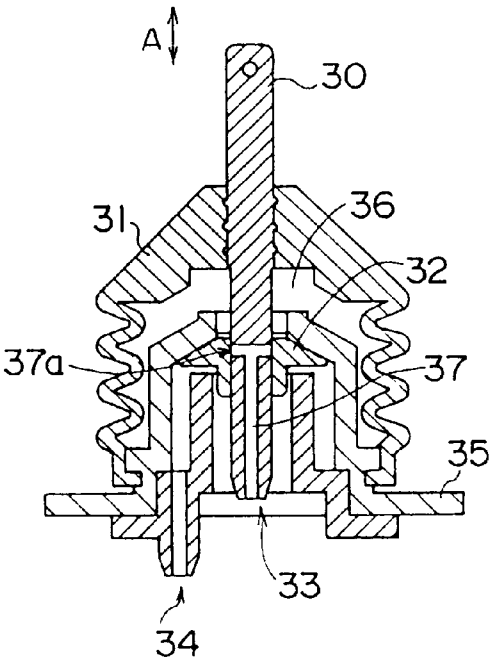
Figure 5A:
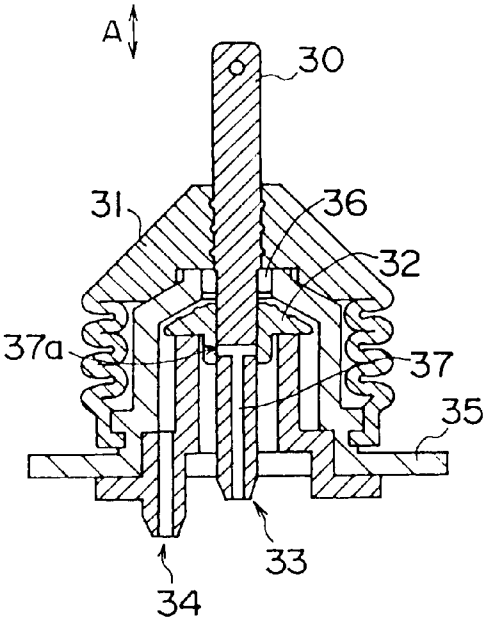

Referring to FIGS. 5A, 5B and 5C, the pump 21 generally comprises the rod 30, a bellows part 31, a slide valve 32, an ink inlet 33, an ink outlet 34 and a valve seat 35. The rod 30 is fixed to the bellows part 31, and the slide valve 32 is slidably coupled to the rod 30. An internal space 36 is formed in the bellows part 31. When the rod 30 is driven to make a reciprocating motion in a direction indicated by the arrow A and parallel with a central axis of the rod 30, the bellows part 31 is expanded or compressed so that the volume of the internal space 36 is increased or decreased, accordingly. An ink passage 37 is provided in the rod 30. The ink inlet 33 is provided at an end of the ink passage 37 and a hole 37*a* is provided at its other end. The ink inlet 33 communicates with the nozzle cap 20 via an ink passage including the tube 23 shown in FIG. 3. The hole 37*a* provided at the end of the ink passage 37 of the rod 30 is covered by the slide valve 32 to be closed with respect to the internal space 36 or to open to the internal space 36, depending on the relative position of the slide valve 32 and the rod 30. The slide 32 slides along the rod 30 in response to the reciprocating motion of the rod 30. However, the stroke of the slide valve 32 is shorter than that of the rod 30.

The valve seat 35 constitutes a part for supporting the slide valve 32. The slide valve 32 and the valve seat 35 are disposed in the interior of the bellows part 31 such that the volume of the internal space 36 is minimum in the state shown in FIG. 5A wherein the bellows part 31 is compressed to the end. In this embodiment, a wall defining the ink outlet 34 functions as a stopper for preventing the slide valve 32 from moving below a certain vertical level, as shown in FIG. 5A.

Figures 6A, 6B:
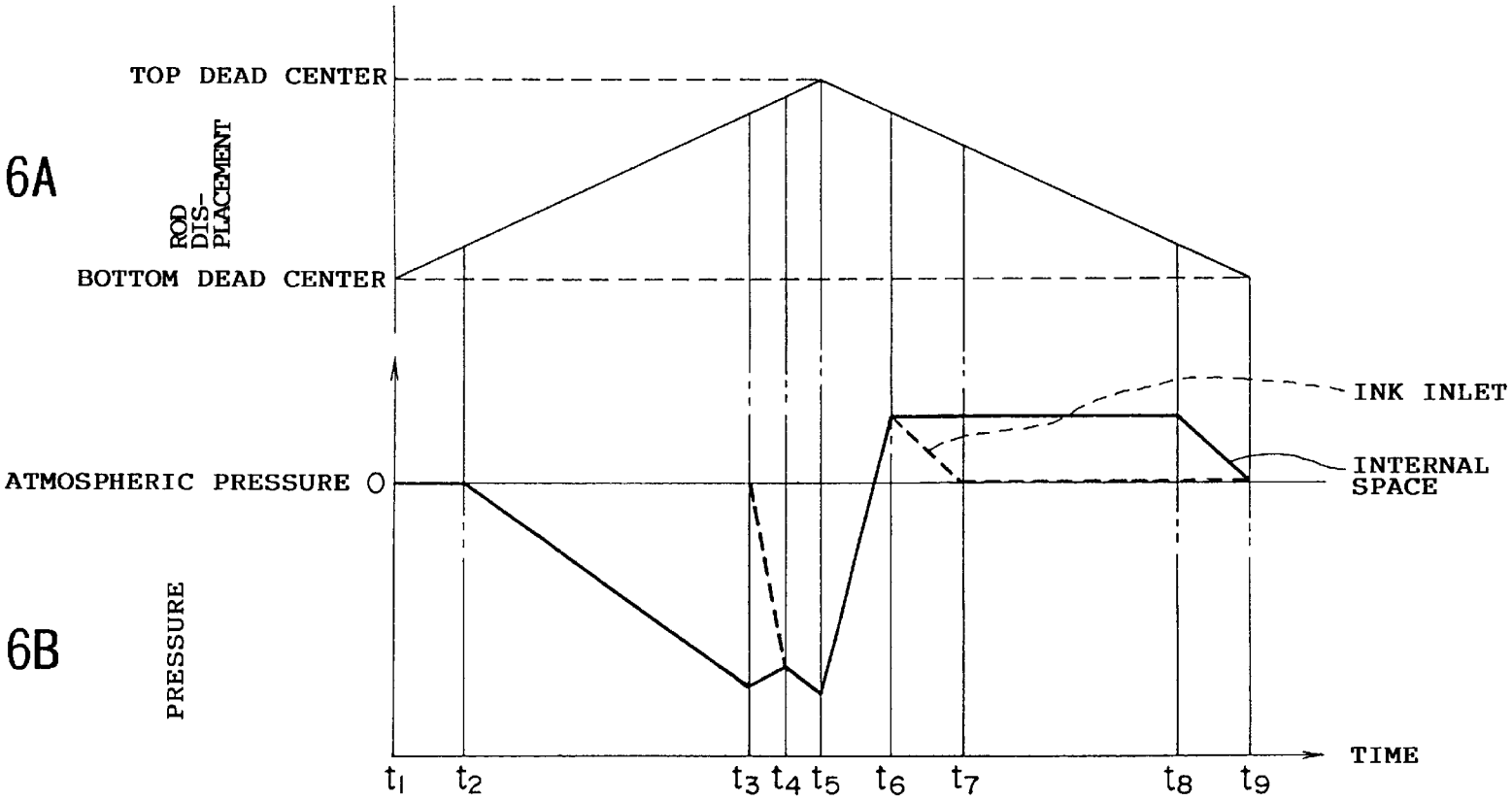
FIGS. 6A and 6B are graphs which explain the purging action effected by the first embodiment of the pump.

FIGS. 6A and 6B are graphs which explain the operation of the pump 21 when the rod 30 is allowed to make a reciprocating motion in the direction indicated by the arrow A so as to effect a purging action. FIG. 6A is a graph showing a variation in the displacement of the rod 30 with time, and FIG. 6B is a graph showing a variation in the pressure at the ink inlet 33 (that is, the interior of the nozzle cap 20) with time and also a variation in the pressure in the internal space 36 with time. In FIG. 6B, a bold line indicates the pressure in the internal space 36, and a broken line indicates the pressure at the ink inlet 33.

Referring to FIGS. 6A and 6B, at a time t1, the rod 30 starts moving upward in FIGS. 5A through 5C, so as to leave the state shown in FIG. 5A where the rod 30 is at the bottom dead center. In response to this upward movement, the slide valve 32 starts moving. At a time t2, the slide valve 32 comes attached to the valve seat 35 and a negative pressure starts to build up in the internal space 36. As shown in FIG. 5B, since the hole 37*a* at the end of the ink passage 37 is covered by the slide valve 32, the pressure at the ink inlet 33 is maintained at the atmospheric pressure. At a time t3, the hole 37*a* at the end of the ink passage 37 opens to the internal space 36 so that the negative pressure is applied to the ink inlet 33 in a burst and causes the ink to be sucked rapidly. As is clearly indicated by the pressure variation graph of FIG. 6B, a relatively small power for driving the pump 21 produces a negative pressure large enough to cause the ink to be sucked more rapidly in this embodiment than in a construction wherein the ink inlet and the pump is connected to each other directly.

At a time t4, the pressure in the internal space 36 increases temporarily because the ink inlet 33 opens to the internal space 36. However, at a time t5, when the rod 30 reaches the top dead center and the pump 21 is in the state shown in FIG. 5C, the pressure in the internal space 36 drops again.

Beyond the time t5, the rod 30 starts moving downward in FIG. 5C so that the compression of the internal space 36 begins. As shown in FIG. 5C, at a timing between the time t5 and the time t6, the slide valve 32 separates from the valve seat 35 from the state shown in FIG. 5C. As a result, the internal space 36 and the ink outlet 34 communicate with each other so that the injection of the ink from the ink outlet 34 of the pump 21 is started. At a time t6, the hole 37*a* of the ink passage 37 is covered by the slide valve 32 again so that the pressure at the ink inlet 33 gradually returns to the atmospheric pressure.

During a period between the time t6 and a time t8, the pressure in the internal space 36 remains constant, and during a period between a time t7 and the time t8, the pressure at the ink inlet 33 is approximately equal to the atmospheric pressure. When the rod 30 comes close to the bottom dead center, the ink injection is terminated. During a period between the time t8 and a time t9, the pressure in the internal space 36 returns to the atmospheric pressure. When the rod 30 reaches the bottom dead center at a time t9, the pump 21 returns to the state shown in FIG. 5A.

Figure 7C:
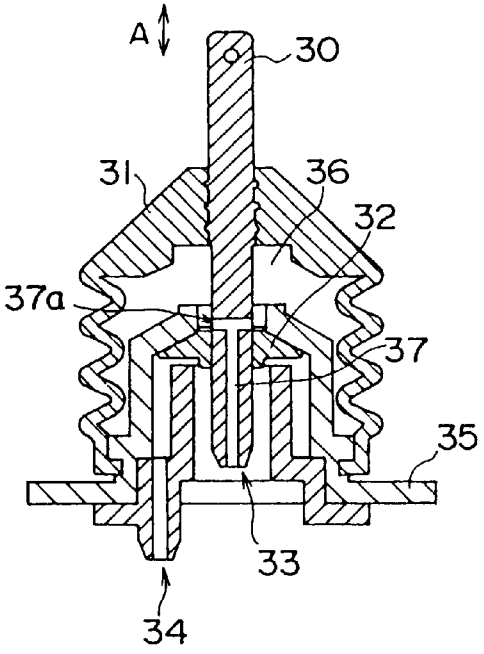
FIGS. 7A, 7B and 7C are sectional views which explain the operation of a second embodiment of the pump.
Figure 7B:
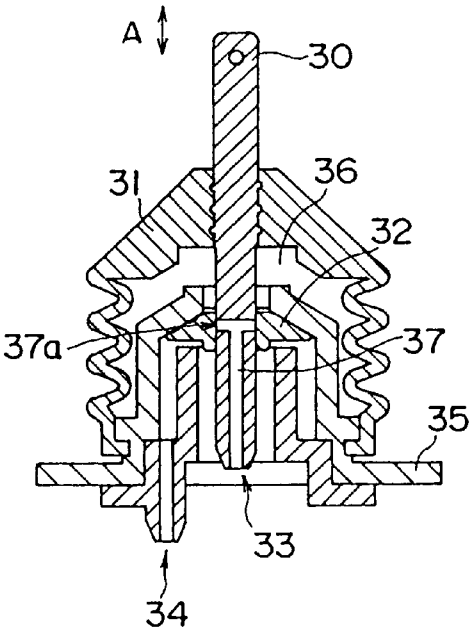
Figure 7A:
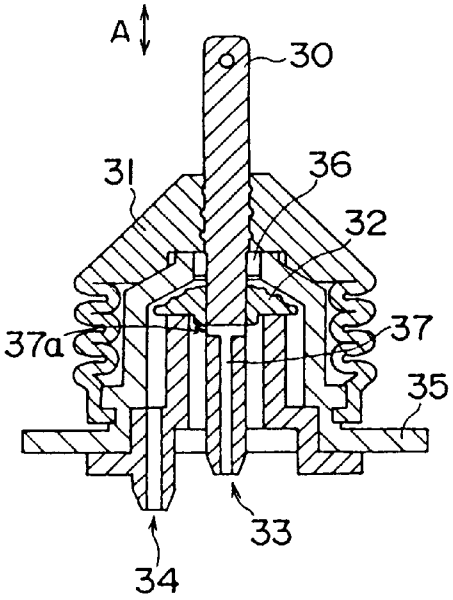

A description will now be given, with reference to FIGS. 7A, 7B and 7C, of a second embodiment of the pump 21. FIG. 7A is a lateral sectional view showing the pump 21 compressed, FIG. 7B is a lateral sectional view showing the pump 21 in an interim state, and FIG. 5C is a lateral sectional view showing the pump 21 expanded. In FIGS. 7A through 7C, those components that are the same as the components shown in FIGS. 5A through 5C are designated by the same reference numerals, and the description thereof is omitted.

In the pump 21 shown in FIGS. 5A through 5C, the hole 37*a* at the end of the ink passage 37 is closed with respect to the internal space 36 in the compressed state shown in FIG. 5A so that the internal space 36 is a closed space. However, the pump 21 shown in FIGS. 7A through 7C differs from the pump 21 shown in FIGS. 5A through 5C in that the hole 37*a* at the end of the ink passage 37 opens to the atmosphere in the compressed state shown in FIG. 7A. The other aspects of the pump 21 are the same as those of the pump 21 shown in FIGS. 5A through 5C.

Figure 8A:
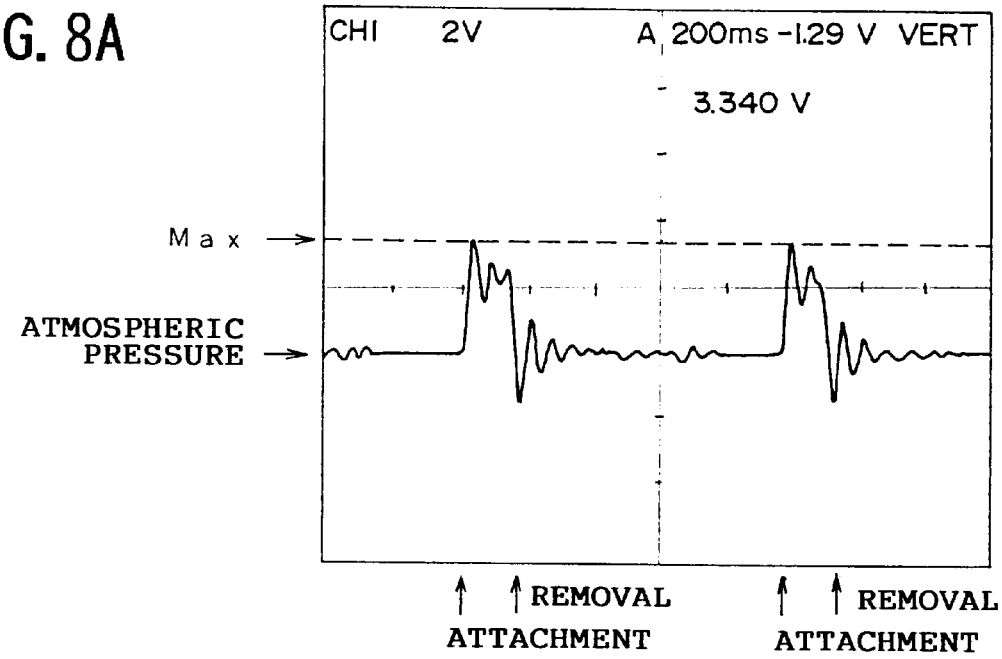
FIGS. 8A and 8B are graphs showing measurement results of a variation in the pressure created in a nozzle cap when the nozzle cap is attached to the print head.
Figure 8B:
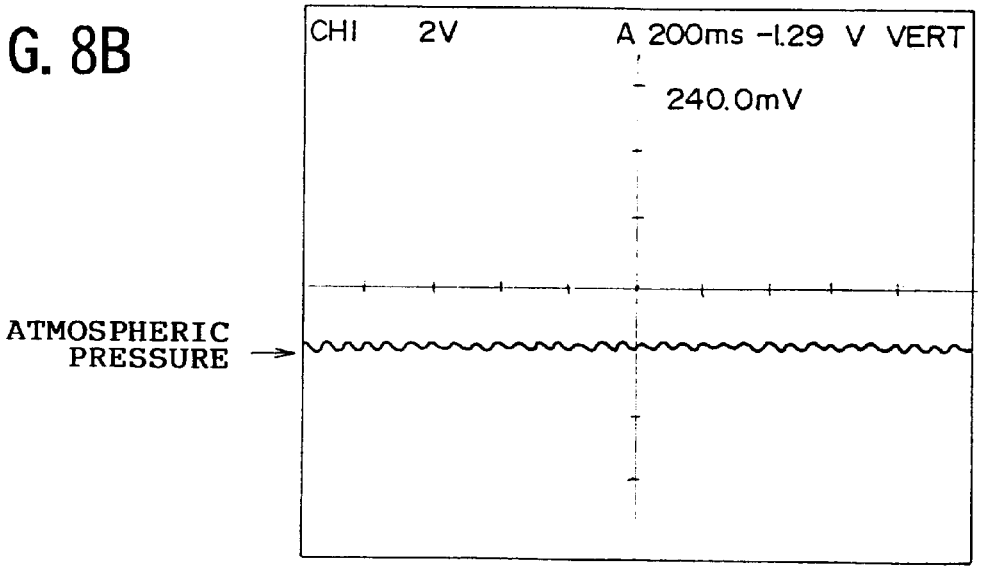

A description will now be given, with reference to FIGS. 8A and 8B, of the operation of the pump 21 shown in FIGS. 7A through 7C. FIGS. 8A and 8B are graphs showing measurement results of a variation in the pressure created in the nozzle cap 20 when the nozzle cap 20 is attached to the print head 11. FIG. 8A is a graph showing the pressure inside the nozzle cap 20 in which the hole 37*a* at the end of the ink passage 37 of the pump 21 is closed in the compressed state. FIG. 8B is a graph showing the pressure inside the nozzle cap 20 in which the hole 37*a* at the end of the ink passage 37 of the pump 21 opens to the atmosphere in the compressed state. FIGS. 8A and 8B show measurement results obtained when a cycle during which the nozzle cap 20 is attached to and detached from the print head 11 is repeated twice.

FIG. 8A clearly shows that a positive pressure is created momentarily and there is a likelihood that an air is forced into the nozzle of the print head 11 due to this positive pressure. on the other hand, FIG. 8B shows that little positive pressure is created and there is no likelihood that an air is forced into the nozzle of the print head 11.

Figures 9A, 9B:
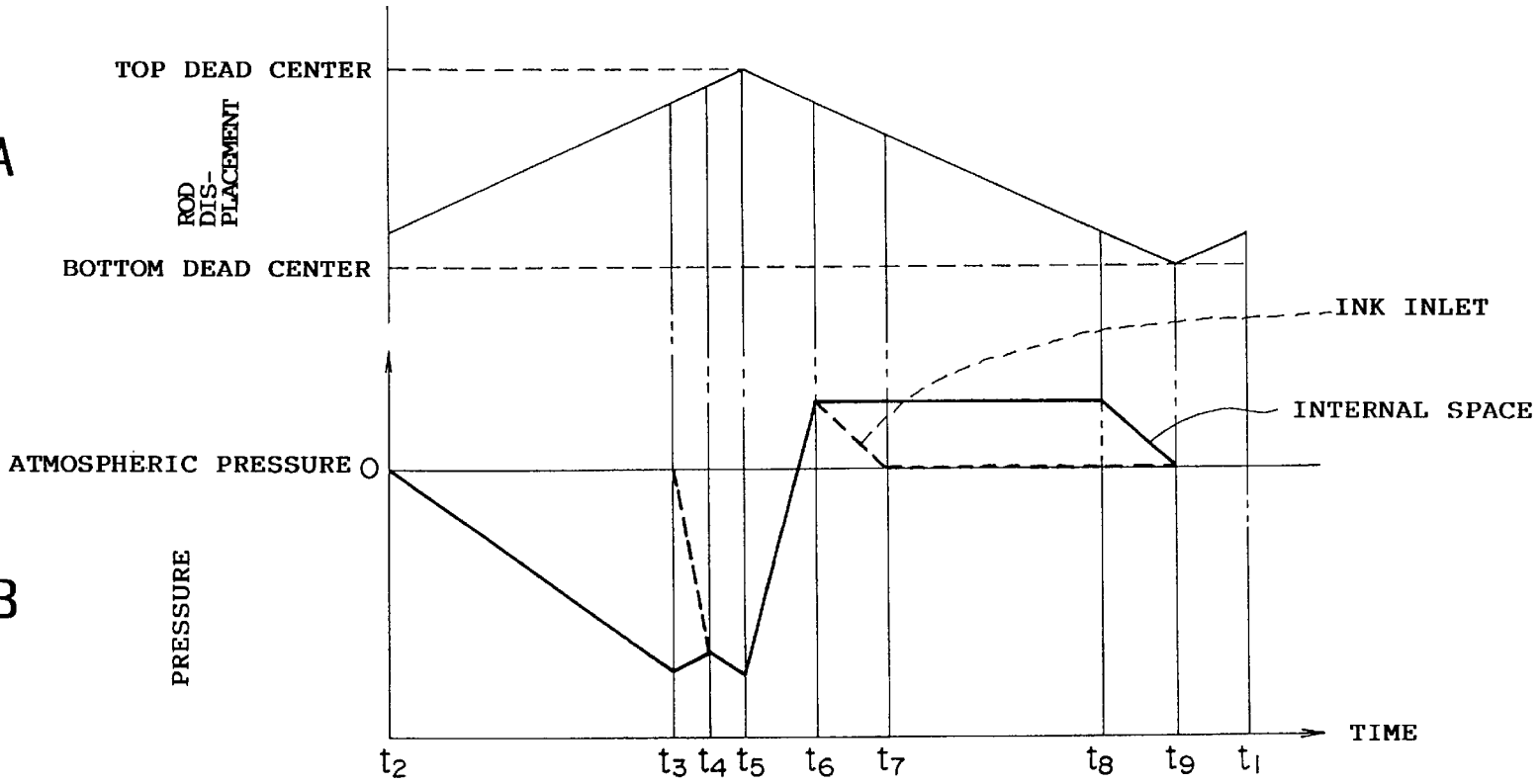
FIGS. 9A and 9B are graphs which explain the purging action effected when the pump is driven using a variation of the method in FIGS. 6A and 6B.

FIGS. 9A and 9B are graphs which explain the action of the pump 21 when a starting point is shifted; that is, when a cycle of the reciprocating motion of the rod 30 in the A direction for carrying out the purging action is made to start at a timing different from the timing of the action of FIGS. 6A and 6B. FIG. 9A is a graph showing a variation in the displacement of the rod 30 with time, and FIG. 9B is a graph showing a variation in the pressure at the ink inlet 33 (that is, the interior of the nozzle cap 20) with time and also a variation in the pressure in the internal space 36 with time. In FIG. 9B, a bold line indicates the pressure in the internal space 36, and a broken line indicates the pressure at the ink inlet 33. In FIGS. 9A and 9B, those parts that are the same as the parts of FIGS. 6A and 6B are designated by the same reference numerals, and the description thereof is omitted.

Referring to FIGS. 9A and 9B, the starting point of action of the pump 21 is shifted to the time t2, and the ending point of the action of the pump 21 is shifted to the time t1. As a result of these shifts, the slide valve 32 is attached to the valve seat 35 when the pump 21 is stationary, thus ensuring that the internal space 36 is sealed. Accordingly, it is possible to prevent the residual ink in the pump 21 from being hardened and affecting the action of the pump 21 unfavorably. The other aspects of the action of the pump 21 indicated in FIGS. 9A and 9B are the same as those of the action indicated in FIGS. 6A and 6B.

Figure 10:
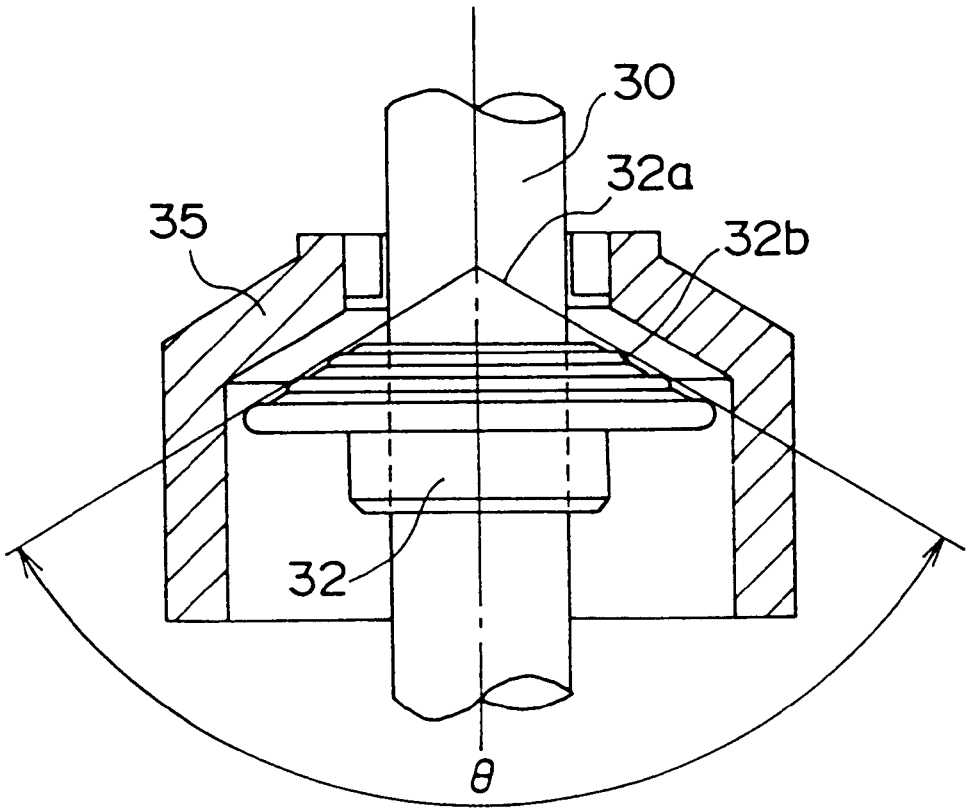
FIG. 10 is a sectional view showing an embodiment of a slide valve.

FIG. 10 is a lateral sectional view of an embodiment of the slide valve 32. The slide valve 32 shown in FIG. 10 is used in the pump 21 shown in FIGS. 5A and 5B or the pump 21 shown in FIGS. 7A and 7B.

Referring to FIG. 10, the slide valve 32 comprises a valve body 32*a* and a plurality of projections 32*b*. The valve body 32*a* generally has a shape of a cone having an apex angle of 120°. If the apex angle is smaller than 90°, the valve body 32*a* tends to mesh with the valve seat 35 as does a wedge, making it impossible for the slide valve 32 to catch up with the reciprocating motion of the rod 30. If the apex angle is greater than 180°, the valve body 32 has a so-called inverse taper, thus creating a large idle space in a state in which the valve body 32*a* is disposed inside the bellows part 31. The pump 21 may become large because of this unnecessary space. Therefore, the apex angle is set to 120° in this embodiment.

Another aspect of this embodiment is that three concentrical projections 32*a* are formed in the valve body 32*a*. The projections 32*a* maintain a satisfactory air tightness between the slide valve 32 and the valve seat 35. Even if paper powder or the hardened ink enters a space between the slide valve 32 and the valve seat 35, it is highly likely that a satisfactory air tightness is maintained.

Figure 11:
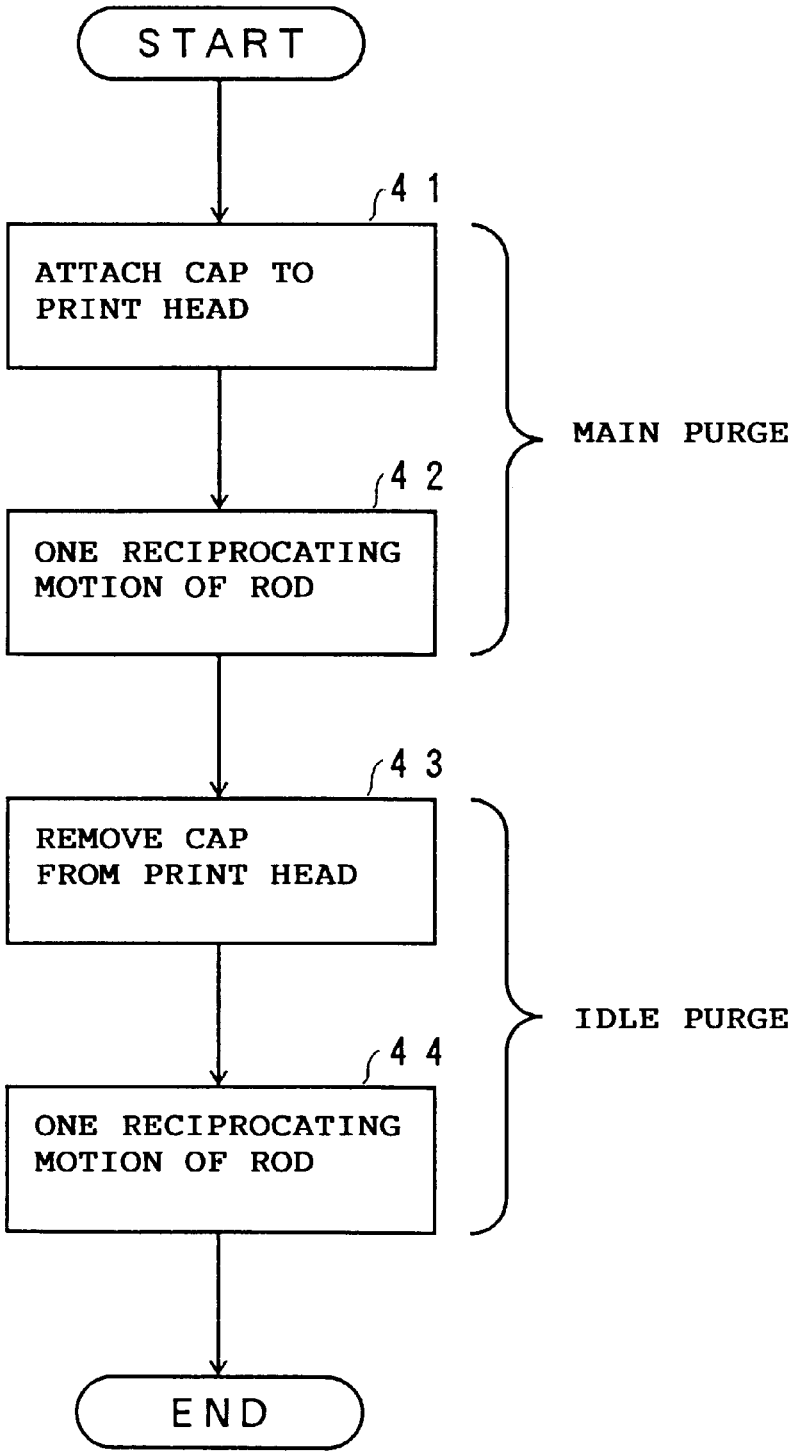
FIG. 11 is a flowchart which explains an embodiment of the purging action.

A description will now be given, with reference to FIG. 11, of an embodiment of the purging action in the first embodiment of the ink-jet printer. FIG. 11 is a flowchart which explains this embodiment of the purging action.

Referring to FIG. 11, in step S41, the nozzle cap 20 is attached to the print head 11 so as to seal the nozzle. In step S42, the purging action is carried out by causing the rod 30 to make one reciprocating motion. A main purge is effected through steps S41 and S42. In step S43, the nozzle cap 20 is detached from the print head 11. In step S44, the rod 30 is caused to make one reciprocating motion. An idle purge is effected through steps S43 and S44, which completes a purging action. In other words, according to this embodiment, one full cycle of purging action is performed by allowing the rod 30 to make two reciprocating motions.

The main purge acts to suck and remove, from the nozzle, the thickened ink, paper powder, the air bubbles that cause the clogging of the nozzle or the improper injection of the ink. The idle purge acts to suck and remove the residual ink that remain in ink passages such as the nozzle cap 20 or the tube 23 after the main purge. In this ways the clogging of the nozzle is positively prevented and a proper injection of the ink is always ensured.

Each of the main purge and the idle purge may be carried out a plurality of times. The purging action may be performed on a periodical basis or when the ink-jet printer is in a predetermined operating condition.

As has been described above, according to the first embodiment of the backup unit and the first embodiment of the ink-jet printer using such a backup unit, a large negative pressure can be produced in a simple, compact construction and using a relatively small power. Hence, it is possible to realize a purging action having a great restoring effect.

A description will now be given, with reference to FIG. 12, of a second embodiment of the ink-jet printer according to the present invention. FIG. 12 is a perspective view of the second embodiment of the ink-jet printer. In FIG. 12, those components that are the same as the components shown in FIG. 1 are designated by the same reference numerals, and the description thereof is omitted.

Referring to FIG. 12, a backup unit 18A has a nozzle cap mechanism 280 comprising: a nozzle cap part including a nozzle cap 20A; and an approach/escape mechanism.

Figure 13:
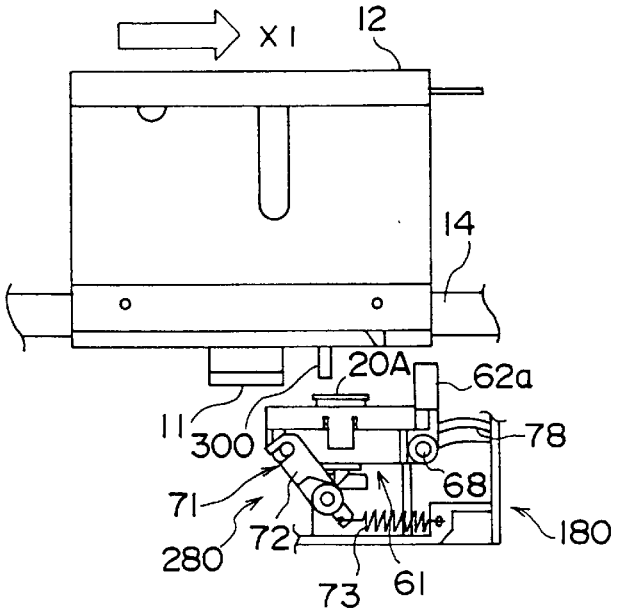
FIG. 13 is a front view which explains an approach/escape action of a nozzle cap part of a nozzle cap mechanism.
Figure 14:
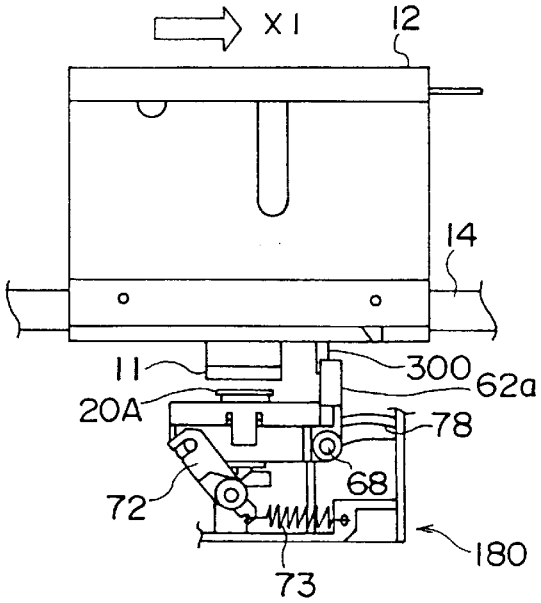
FIG. 14 is a front view which explains the approach/escape action of the nozzle cap part of the nozzle cap mechanism.
Figure 15:
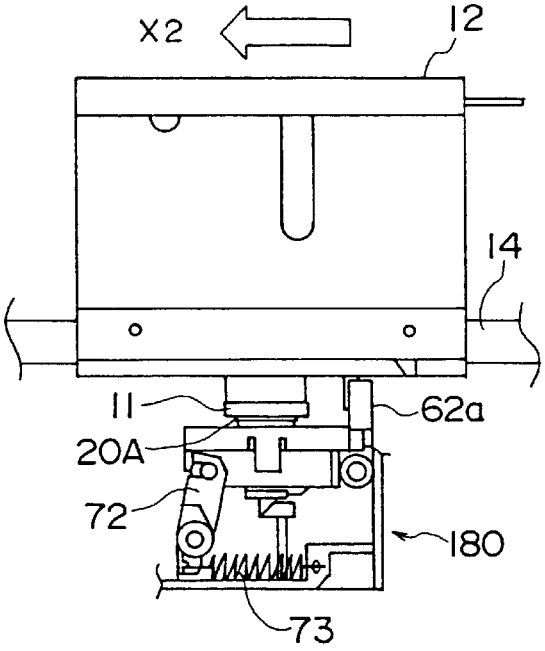
FIG. 15 is a front view which explains the approach/escape action of the nozzle cap part of the nozzle cap mechanism.

FIGS. 13 through 15 are front views which explain the approach/escape action of the nozzle cap part of the nozzle cap mechanism. Referring to FIGS. 13 through 15, the nozzle cap mechanism 280 mechanism generally has a nozzle cap part 61 and an approach/escape mechanism 71.

Figure 16:
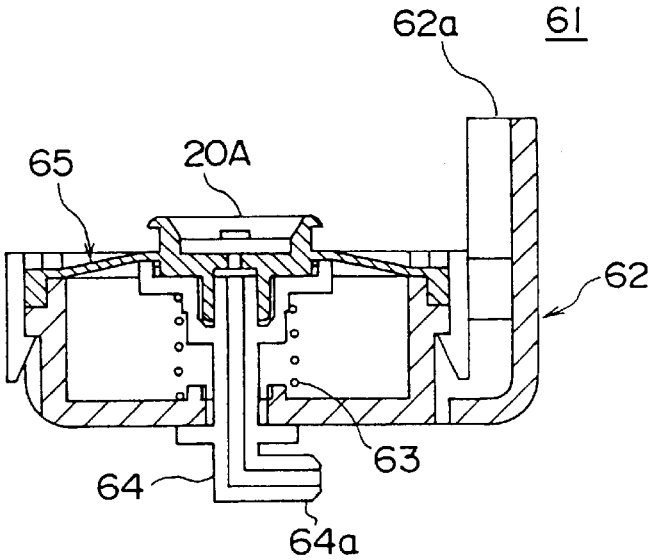
FIG. 16 is a lateral sectional view of the nozzle cap part.

FIG. 16 is a sectional view showing the nozzle cap part 61. Referring to FIG. 16, the nozzle cap part 61 comprises: a nozzle cap main body 62 which generally has the nozzle cap 20A and a cap support 62*a*; a coil spring 63; a cap seat 64; and an elastic film 65.

The nozzle cap 20A is supported by the coil spring 63 and the cap seat 64 and always urged upward in FIG. 16. The elastic film 65 having its inner periphery connected to the nozzle cap 20A and its outer periphery fixed to the nozzle cap main body 62 is connected to the periphery of the nozzle cap 20A. In this way, the nozzle cap 20A is swingably, that is, elastically supported. Preferably, the nozzle cap 20A is formed of an elastic material such as a rubber. More preferably, the nozzle cap 20A and the elastic film 65 are integrally formed of a same elastic material.

The nozzle cap 20A is positioned by the nozzle cap main body 62 and the elastic film 65. Since the pressure from the coil spring 63 is applied to the bottom of the nozzle cap 20A via the entirety of the cap seat 64, the nozzle cap 20A is prevented from making an abnormal deformation. An end part 64*a* of the cap seat 64 is connected to the pump 21 via the tube 23 and functions as a passage for the ink.

As shown in FIGS. 13 through 15, the approach/escape mechanism 71 generally comprises a link 72 and a spring 73. An end of the link 72 is rotatably supported by the nozzle cap main body 62, and the other end of the link 72 is rotatably supported by the housing 180 and connected to an end of the spring 73. The other end of the spring 73 is connected to the housing 180. The housing 180 is the same as the housing shown in FIG. 4 and fixed to the frame 1 of the ink-jet printer. In the above-described construction, the link 72 is always urged counterclockwise in FIGS. 13 through 15.

When the carriage 12 is moved in a direction indicated by the arrow X1 in FIG. 13, the print head 11 approaches the stand-by position at the right end of its translation. At the stand-by position, the relative position of the print head 11 and the nozzle cap mechanism 280 is as shown in FIG. 14. In the state shown in FIG. 14, a projection 300 provided in the carriage 12 or the print head 11 is in contact with the cap support 62*a*. As a result of this contact, the nozzle cap part 61 starts moving upward in FIG. 13 against the force exerted by the spring 73. At the same time, the nozzle cap part 61 is also moved in the direction indicated by the arrow X1 together with the print head 11 so that the nozzle cap 20A is maintained in its position opposite to the print head 11. As the nozzle cap part 61 is moved upward and in the X1 direction, a pin 68 provided in the nozzle cap main body 62 is guided by a guide groove 78 provided in the housing 180.

When the carriage 12 leaves the state shown in FIG. 14 by being moved further in the X1 direction so that the print head 11 reaches the stand-by position shown in FIG. 15, the nozzle cap 20A is attached to the print head 11 so as to seal the nozzle completely. Even when the nozzle cap 20A fails to approach the nozzle of the print head 11 in a most suitable position; that is, even when the nozzle cap 20A fails to be parallel with the print head 11, any displacement of the nozzle cap 20A from the most appropriate position can be canceled elastically, because the nozzle cap 20A is swingably, that is, elastically supported (the causes for the displacement include the errors in mounting the carriage 12, the print head 11 or the nozzle cap 20A itself, and the bending force of the tube 23 connected to the nozzle 20A). Accordingly, it is always possible to seal the nozzle completely. A problem that the negative pressure fails to be produced during the purging action because of a gap created between the print head 11 and the nozzle cap 20A is eliminated.

Referring to FIG. 15, when the carriage 12 leaves the stand-by position by moving in a direction indicated by the arrow X2, an action reverse to the above-described action causes the nozzle cap 20A to be separated from the print head 11. Finally, the nozzle cap mechanism 280 returns to the state shown in FIG. 13.

It is assumed in the foregoing embodiments that one nozzle is provided in one print head and one nozzle cap is provided in one nozzle. However, a plurality of print heads may be provided and a plurality of nozzles may be provided. The present invention is also applicable, for example, to a construction in which a plurality of nozzles are provided in one print head. Further, one nozzle cap may be provided in correspondence to a plurality of nozzles, or a plurality of nozzle caps may be provided in correspondence to a plurality of nozzles.

The present invention is not limited to the above described embodiments, and variations and modifications may be made without departing from the scope of the present invention.

What is claimed is:

1. A backup unit, which is provided with respect to a nozzle of a print head for printing by injecting ink, and which sucks said ink from said nozzle, said backup unit comprising:

a nozzle cap sealing said nozzle by making contiguous contact with said print head;

a pump; and an ink path provided between said nozzle cap and said pump for communication between said nozzle cap and said pump, wherein said pump comprises:

a bellows part having an internal space formed therein;

a movable rod fixed to said bellows part and having an ink passage therein;

a slide valve provided in said bellows part and slidable with respect to said rod, said slide valve closing and opening a hole provided at a first end of said ink passage with respect to said internal space, depending on a position of said movable rod and, wherein said slide valve comprises a valve body having a generally cone shape with an apex angle in a range of 90 degrees to 180 degrees, and a plurality of concentric projections provided on said valve body, said concentric projections maintaining airtightness within said pump;

an ink inlet provided at a second opposed end of said ink passage and communicating with said ink path; and an ink outlet communicating with said internal space depending on a position of said slide valve, said slide valve having a stroke shorter than a stroke of said rod, a volume of said internal space within said bellows part increasing and decreasing as said slide valve makes a reciprocating motion in a direction parallel to a center axis of said rod, said slide valve sucking said ink from said nozzle through said ink inlet by opening said hole of said ink passage to said internal space when said rod is at a position where said volume of said internal space is a maximum volume, and discharging said ink in said internal space through said ink outlet as said volume of said internal space decreases.

2. The backup unit as claimed in claim 1, wherein said slide valve opens said hole of said ink passage to atmospheric conditions when said rod is at a position where said volume of said internal space is approximately a minimum volume.

3. The backup unit as claimed in claim 1, wherein said slide valve makes said internal space a closed space by closing said hole of said ink passage with respect to said internal space when said rod is at a position where said volume of said internal space is approximately a minimum volume.

4. The backup unit as claimed in claim 1, further comprising driving means for driving said rod to make at least one reciprocating motion in a state where said nozzle cap is in contiguous contact with said print head and to make at least one reciprocating motion in a state where said nozzle cap is separated from said print head.

5. The backup unit as claimed in claim 1, further comprising a mechanism resiliently supporting said nozzle cap.

6. The backup unit as claimed in claim 5, further comprising a mechanism moving said nozzle cap substantially parallel to said print head so that said nozzle cap makes contiguous contact with said print head in response to a movement of said print head to a stand-by position.

* * * * *